US008944894B2

(12) United States Patent
Smith et al.

(10) Patent No.: US 8,944,894 B2
(45) Date of Patent: Feb. 3, 2015

(54) ADJUSTABLE ABRASIVE SHARPENER

(71) Applicants: Richard S. Smith, Hot Springs, AR (US); Louis Chalfant, Hot Springs, AR (US)

(72) Inventors: Richard S. Smith, Hot Springs, AR (US); Louis Chalfant, Hot Springs, AR (US)

(73) Assignee: Smith's Consumer Products, Inc., Hot Springs, AR (US)

( * ) Notice: Subject to any disclaimer, the term of this patent is extended or adjusted under 35 U.S.C. 154(b) by 214 days.

(21) Appl. No.: 13/660,944

(22) Filed: Oct. 25, 2012

(65) Prior Publication Data

US 2014/0120812 A1 May 1, 2014

(51) Int. Cl.
*B24B 19/00* (2006.01)
*B24D 15/08* (2006.01)

(52) U.S. Cl.
CPC ..... *B24D 15/082* (2013.01); *Y10S 451/918* (2013.01)
USPC ..... 451/552; 451/45; 451/196; 451/555; 451/918; 76/82; 76/86

(58) Field of Classification Search
CPC ..... B24B 3/54; B24B 19/002; B24B 19/001
USPC ..... 451/45, 196, 552, 555; 76/82, 86, 88
See application file for complete search history.

(56) References Cited

U.S. PATENT DOCUMENTS

| | | | | | |
|---|---|---|---|---|---|
| 558,407 | A | | 4/1896 | Miller | |
| 1,041,631 | A | * | 10/1912 | Johnson | 451/486 |
| 1,170,898 | A | | 2/1916 | Hancock | |
| 1,909,743 | A | * | 5/1933 | Blankner | 451/486 |
| 2,519,351 | A | * | 8/1950 | Calvert | 451/164 |
| 2,542,472 | A | | 2/1951 | Brinkley | |
| 2,683,385 | A | | 7/1954 | Murchison | |
| 2,795,156 | A | | 6/1957 | Murchison | |
| 4,235,050 | A | * | 11/1980 | Hannaford et al. | 451/151 |
| 4,807,399 | A | * | 2/1989 | Friel | 451/45 |
| 4,934,110 | A | * | 6/1990 | Juranitch | 451/486 |
| 5,440,953 | A | * | 8/1995 | Gangelhoff et al. | 76/86 |
| 6,866,569 | B2 | * | 3/2005 | Cozzini | 451/349 |
| 6,875,093 | B2 | * | 4/2005 | Friel et al. | 451/260 |
| 6,881,137 | B2 | * | 4/2005 | Friel, Sr. | 451/349 |
| 7,108,595 | B2 | * | 9/2006 | Reisinger | 451/461 |
| 7,121,935 | B2 | * | 10/2006 | Pretorlus | 451/321 |
| 7,172,500 | B1 | * | 2/2007 | Wu et al. | 451/319 |
| 8,267,749 | B2 | * | 9/2012 | Smith et al. | 451/349 |
| 2003/0077990 | A1 | * | 4/2003 | Li | 451/293 |
| 2006/0040598 | A1 | * | 2/2006 | Koppe | 451/349 |
| 2007/0281590 | A1 | * | 12/2007 | Friel et al. | 451/45 |
| 2010/0199826 | A1 | * | 8/2010 | Ikoma et al. | 83/471 |
| 2011/0201257 | A1 | * | 8/2011 | Walker | 451/45 |

* cited by examiner

*Primary Examiner* — George Nguyen
(74) *Attorney, Agent, or Firm* — Edward D. Gilhooly

(57) ABSTRACT

An adjustable manual abrasive sharpener having a pair of sharpening slots formed in a frame with opposing abrasive arms being pivotally mounted in each of the sharpening slots. A rod is mounted on the frame for rotatable motion and for linear motion long its axis of rotation from a position at which the rod is locked against rotation to a depressed position whereby the rod may be rotated. The bottom end portion of the rod includes a pinion gear which engages a pair of gear racks which are mounted for movement laterally relative to the axis of rotation of the rod. The pair of gear racks respectively engage slots formed on the bottom of the abrasive arms in each sharpening slot. Rotation of the rod causes movement of the gear racks to adjust each pair of abrasive arms with respect to each other to vary the sharpening angle of the abrasive elements.

19 Claims, 6 Drawing Sheets

ADJUSTABLE ABRASIVE SHARPENER

BACKGROUND OF THE INVENTION

This application claims priority to provisional application Ser. No. 61/632,038 filed Jan. 17, 2012.

FIELD OF THE INVENTION

This invention relates to sharpening knives and the like, and more particularly, to an improved adjustable abrasive sharpener.

SUMMARY OF THE PRIOR ART

In the prior art numerous abrasive sharpeners for knives and the like exist having fixed abrasive elements forming a V-shaped sharpening slot. Such known fixed abrasive elements are oriented at a fixed angle to sharpen a blade at an angle as desired for a range of different knife types. Most sharpeners are set at either a standard angle and/or an Asian angle that is preset and static. All manufacturers use blades that produce set knife angles that may vary from knife style to another. These varying set angles may not match the standard or santoku angle of prior fixed angle sharpeners. Accordingly, it is desirable in the prior art to provide an adjustable V-shaped sharpener by which the sharpening angle may be varied to range of sharpening angles to more closely match the prescribed sharpening angle of the knife edge from the original blade manufacture.

SUMMARY OF THE INVENTION

It is therefore an objective of the invention to provide an improved abrasive knife sharpener having adjustable abrasive elements to selectively vary the sharpening angle of a blade. The sharpener includes a pair of pivotally mounted abrasive elements forming a sharpening slot whereby the abrasive elements can selectively be moved toward and away from each other to vary their orientation and sharpening angle. Such adjustability is achieved by a rotary adjustment mechanism for ease of use and significant control of the angle between a respective pair of abrasive elements. By varying the angle between the abrasive elements the user may select a sharpening angle that more closely matches the prescribed manufacture specifications.

DESCRIPTION OF THE PREFERRED EMBODIMENT

Figure 1:
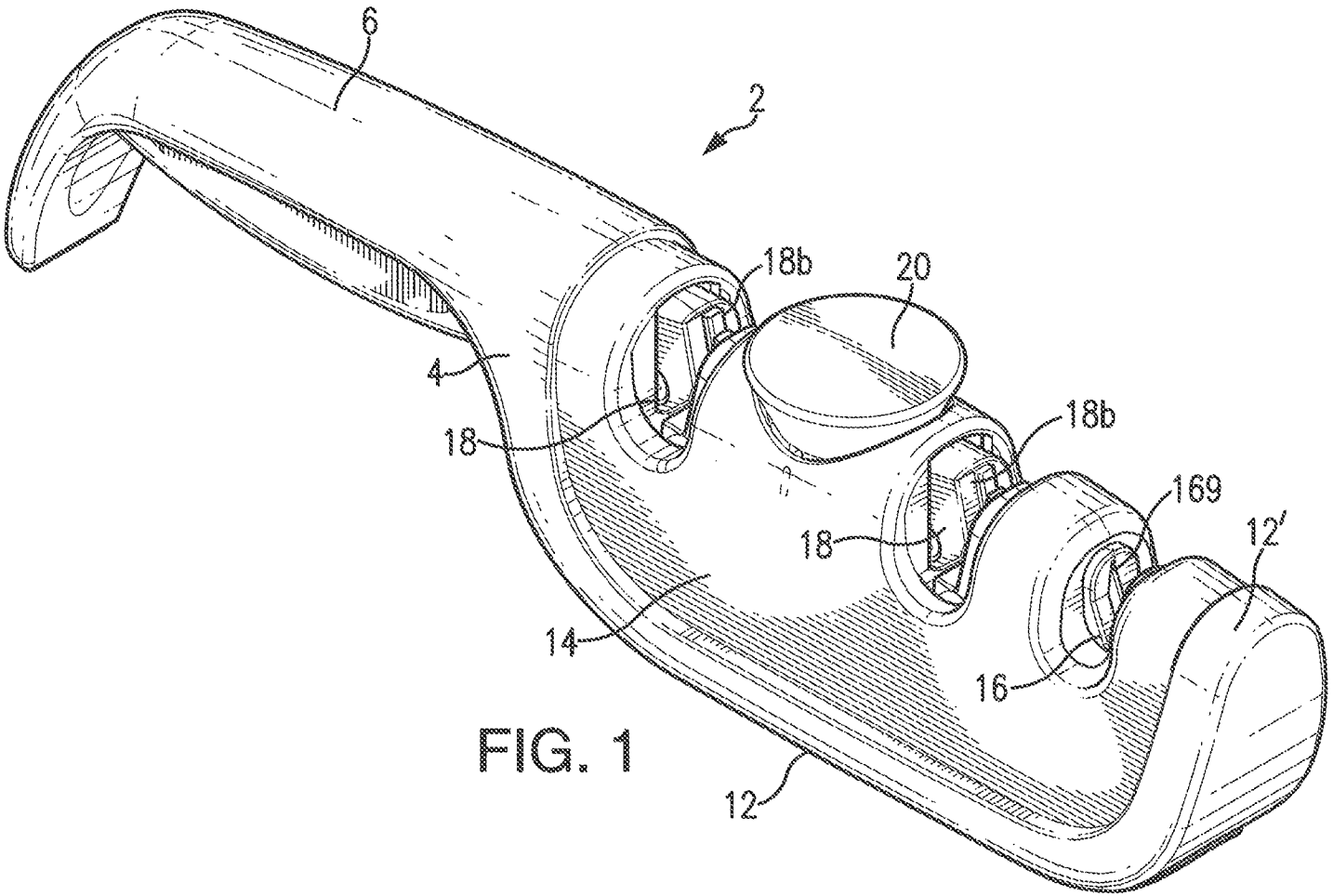
FIG. 1 is a front perspective view of the adjustable abrasive sharpener of the invention.
Figure 2:
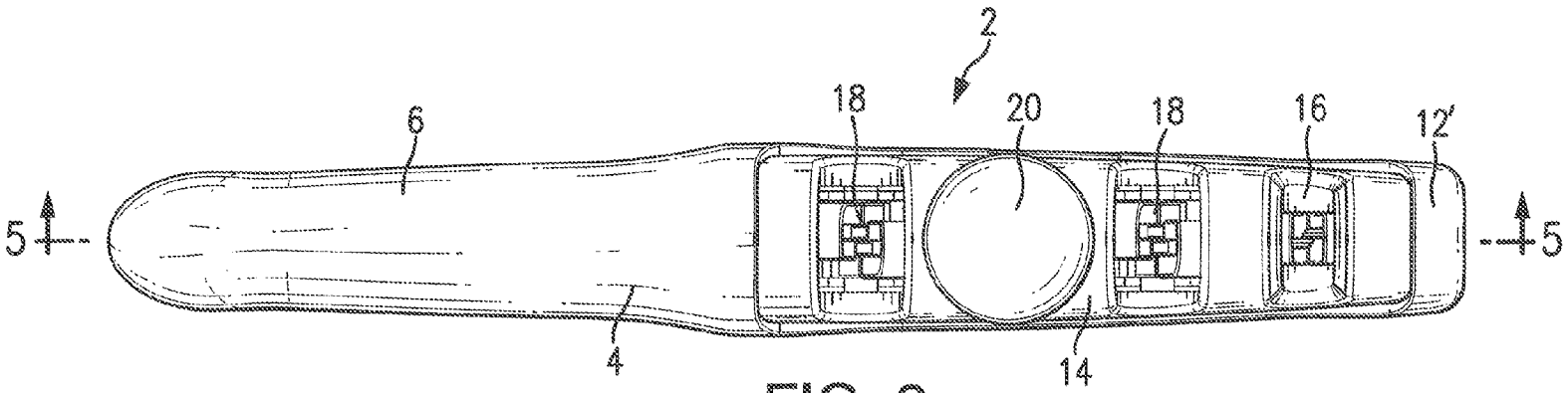
FIG. 2 is a top plan view of the adjustable abrasive sharpener of FIG. 1.
Figure 3:
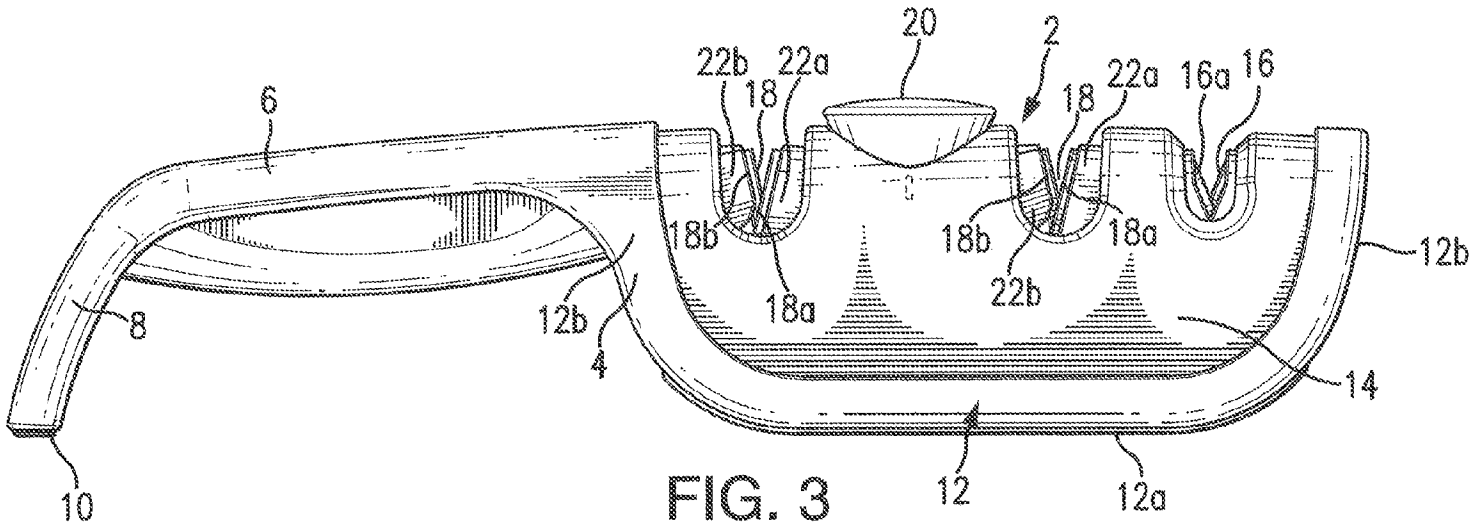
FIG. 3 is a front elevational view of the adjustable abrasive sharpener of FIG. 1.
Figure 4:
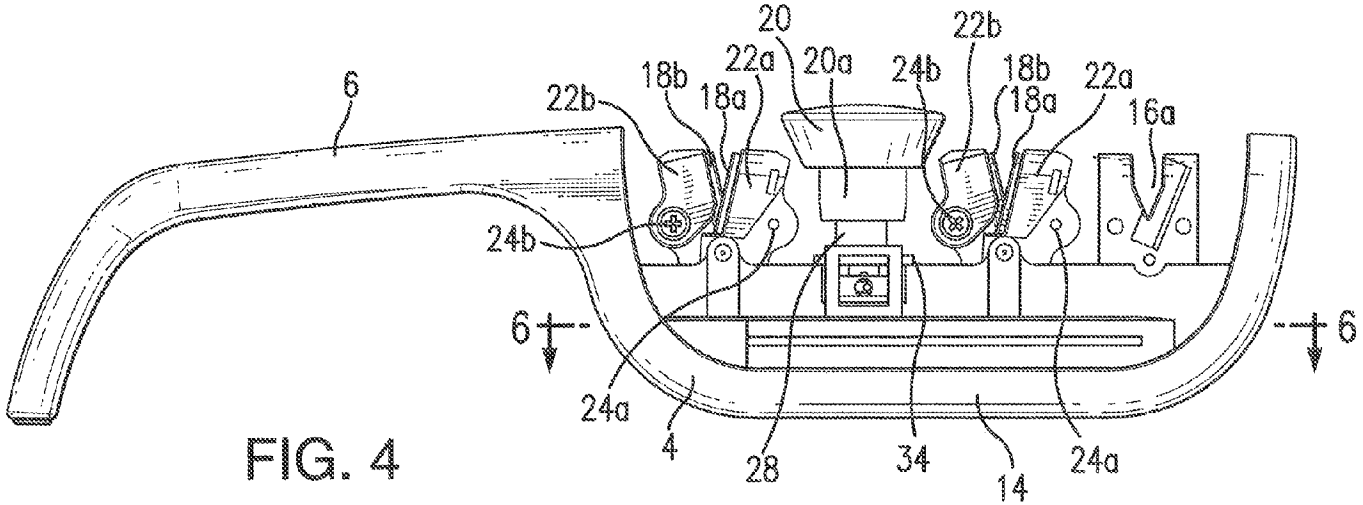
FIG. 4 is a front elevational view, with the cover removed, of the adjustable abrasive sharpener of FIG. 1.

Referring now to FIGS. 1-13, there is illustrated the adjustable abrasive sharpener of the invention for sharpening knife blades and the like, generally designated by reference numeral 2. Although the sharpener 2 discloses a manual adjustment of the sharpening angle, it is within the scope of the invention to employ other techniques employing the invention, such as an electro-mechanical mechanism (not shown) and the like. As best seen in FIGS. 1-3, the abrasive sharpener 2 includes an elongated frame 4 forming a handle portion 6 at one end. The end 8 of handle 6 curves downward and includes a flat bottom surface 10 which serves as a support area during sharpening. The frame 4 further includes upwardly opening U-shaped section 12 forming a bottom support surface 12*a* and a curve upward extending portion 12*b* (FIGS. 3). A housing 14 is positioned within the U-sharped section 12. A sharpening slot 16 having abrasive elements 16*a* which are oriented to each other at a generally fixed V-angle is provided on the top of housing 14. A pair of additional slots 18 are formed on the top of housing 14 and each include a pair of pivotally mounted abrasive elements 18*a*, 18*b* forming an adjustable generally V-angle to be capable of varying the sharpening angle of the blade of a knife dependent on desired results. As will be apparent from the following description, the abrasive elements 18*a*, 18*b* can simultaneously be adjusted toward and away from each other through rotation of exterior adjustment actuator, such as knob 20, which is shown being situated between the two respective slots 18. It is within the scope of the invention, however, to situate the knob 20 on either side of one of the adjustable slots 18 or other desired position where convenient.

Figure 7:
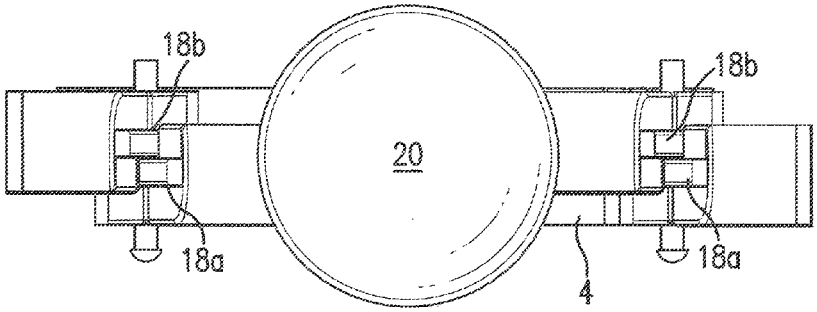
FIG. 7 is a top partial plan view of the adjustable arms of the adjustable abrasive sharpener of FIG. 1.
Figure 8:
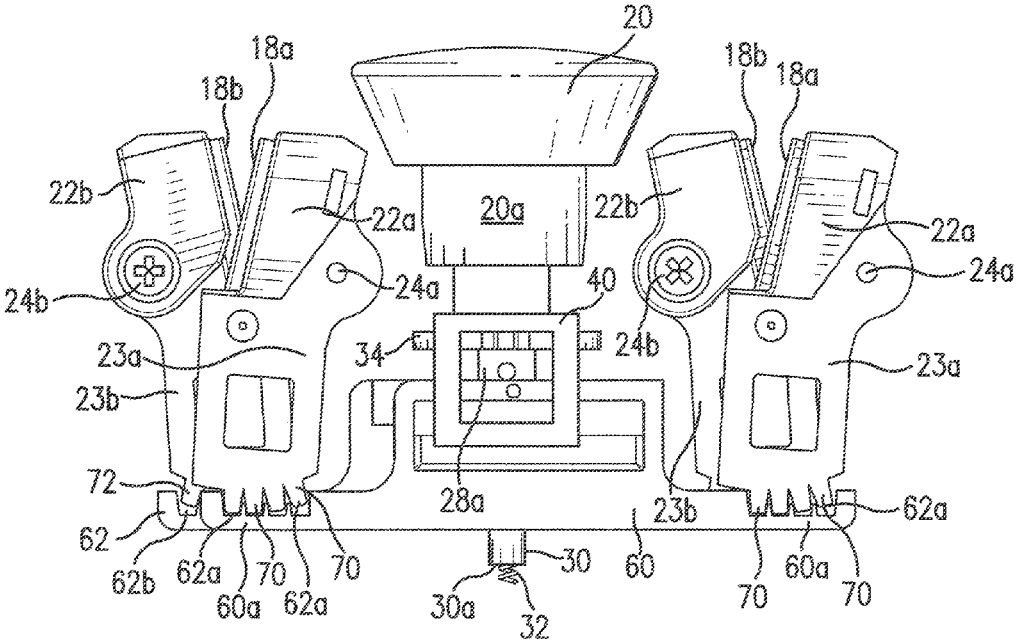
FIG. 8 is a front partial elevational view of the adjustable arms of the adjustable abrasive sharpener of FIG. 1.
Figure 9:
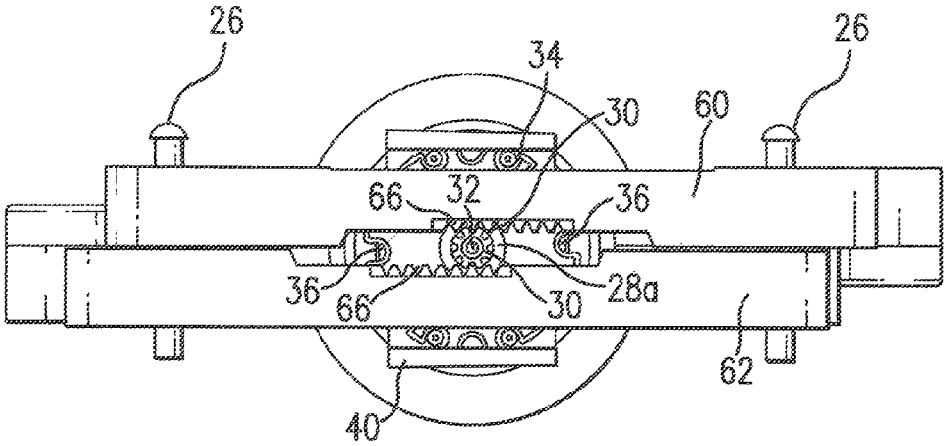
FIG. 9 is a bottom partial plan view of the rack and pinion of the adjustable abrasive sharpener of FIG. 1.

As previously described, the abrasive elements 18*a* and 18*b* in each slot 18 are arranged with respect to each other to form a cutting slot having a generally V-configuration to sharpen an inserted blade edge (not shown) through its movement through the slots 18. The abrasive elements 18*a* are affixed to a removable support 22*a* mounted on pivotal arm 23*a* by a threaded member 24*a* as seen in FIGS. 4, 5, 8, and 10. The opposing abrasive elements 18*b* are affixed to a removable support 22*b* mounted on a removable arm 23*b* by a threaded member 24*b*. The pivot arms 22*a*, 22*b* of both adjustable slots are pivotally mounted on pivot pin 26. As seen in FIGS. 7, 8, and 11, the arms 23*a* and 23*b* are offset from other in a lateral direction relative to the frame 4 and extend downward.

The hub 20*a* of the adjustment knob 20 is suitably secured to a downwardly extending rod 28 having a lower open ended reduced end portion 28*a* and acting as part of the adjustment actuator of the invention. A lower elongated pinion 30 is secured end portion 28*a* (FIGS. 5, 6 and 8-10). A spring 32 is disposed between the lower end 30*a* of pinion 30 and a portion of frame 4 (FIGS. 5, 8, 9 and 10) A circular plate 34 having a plurality of open engagement slots 36 arranged on its periphery for an extent of 360° is rigidly mounted on rod 28 (FIGS. 4, 8, 9, and 12). The rod 28, pinion 30, and plate 34 are mounted on frame 4 to be rotated for a predetermined range and be vertical moved a limited degree through use of knob 20 as will be apparent.

Figure 13:
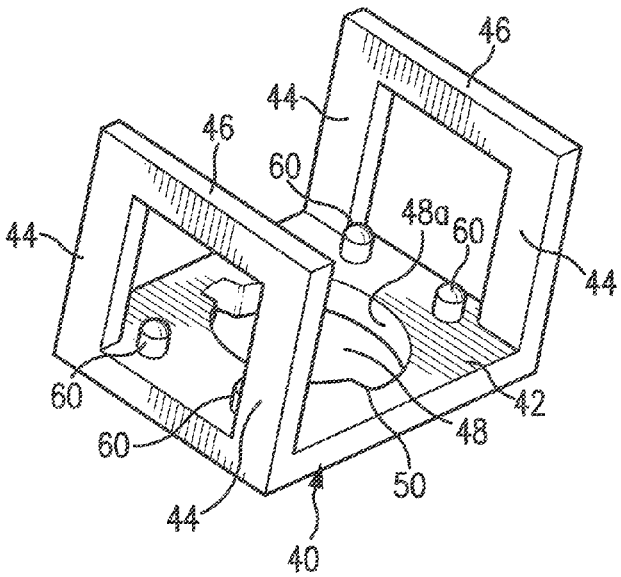
FIG. 13 is bottom perspective view of the angle locking bracket of the adjustable abrasive sharpener of FIG. 1.

As best seen in FIGS. 8, 9, 10, 11 and 13, an angle locking bracket 40 is mounted in fixed relationship on frame 4. As seen in FIG. 13, the angle locking bracket 40 has an upper plate 42 supported on opposed pairs of spaced legs 44 which are interconnected by an opposed based members 46. A modified circular opening 48 is formed in plate 42. A cut-out area 48*a* exceeding the radius of opening 48 extends from a stop surface 50 to a second stop surface 52 (FIG. 11) limits the amount of rotation of shaft 28 by knob 20. To accomplish the foregoing result, vertical keys 54 exteriorly projecting on rod 28 rotates in cut-out area 48*a* for maximum angle of rotation as established between stop surfaces 50, 52 (FIGS. 11 and 13). Four engagement pins 60 extend downward from plate 42 of the angle locking bracket 40. In the uppermost position of knob 20 and rod 28 the pins 60 extend into four respective engagement slots 36 of circular plate 34 and lock rod 28 and pinion 30 against rotation. By pressing knob 20 downward to compress spring 32, the locked engagement slots 36 move away from the engagement pins 60 and the rod 28 and pinion 30 can be rotated to the extent determined by stops 50, 52 as they contact keys 54. The extent of rotation determines the adjustment of the sharpening angle between abrasive elements 18*a* and 18*b* of both adjustable sharpening slots.

Figure 5:
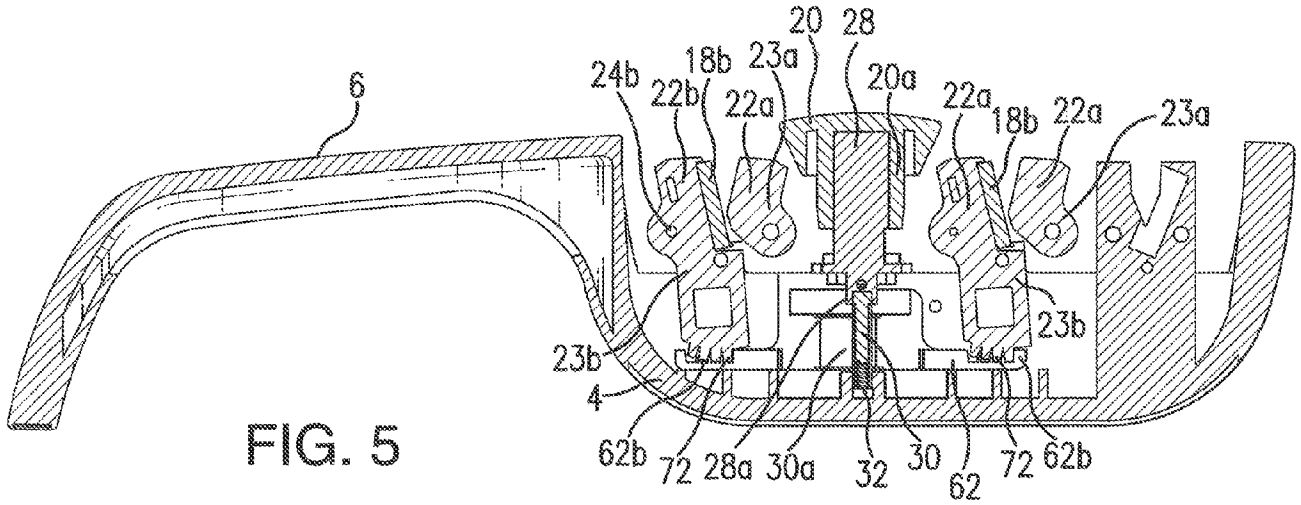
FIG. 5 is a front elevational view, with parts in section, taken along lines 5-5 of FIG. 2.
Figure 6:
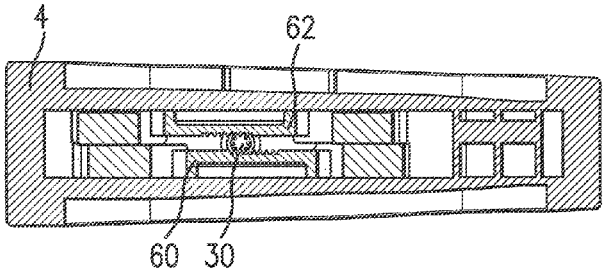
FIG. 6 is a top plan view, with parts in section, taken along lines 6-6 of FIG. 4.

A pair of connecting members 60,62 in the form of adjustment gear racks are mounted by suitable means on frame 4 for relative reciprocal movement in a direction perpendicular to the axis of rotation of rod 28 as seen in FIGS. 6, 8, 9, and 10. The rack 60 includes linear rack gear section 64 which engages pinion 30 at all position vertical positions of rod 28. The rack 62 includes linear rack gear section 66 and engages pinion 30 at all suitable vertical positions of rod 28. The pinion 30 moves the adjustment racks in opposite directions in either direction of rotation of rod 28 when the engagement pins are released. The end portions 60*a* of adjustment racks 60 include a plurality of upwardly opening slots 62*a*. The end portions 62*a* of adjustment racks 62 include a plurality of upwardly opening slots 62*b* (FIG. 5).

Figure 10:
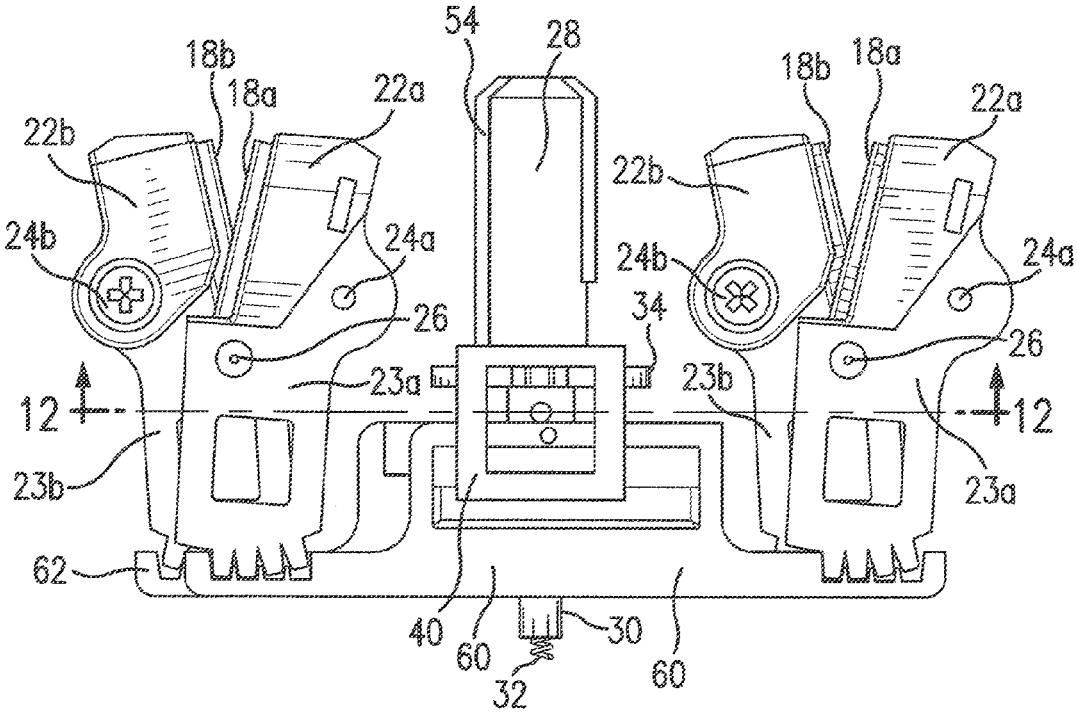
FIG. 10 is a partial front elevational view, with parts removed, of the adjustable mounting of the abrasive elements of the invention of FIG. 1.
Figure 11:
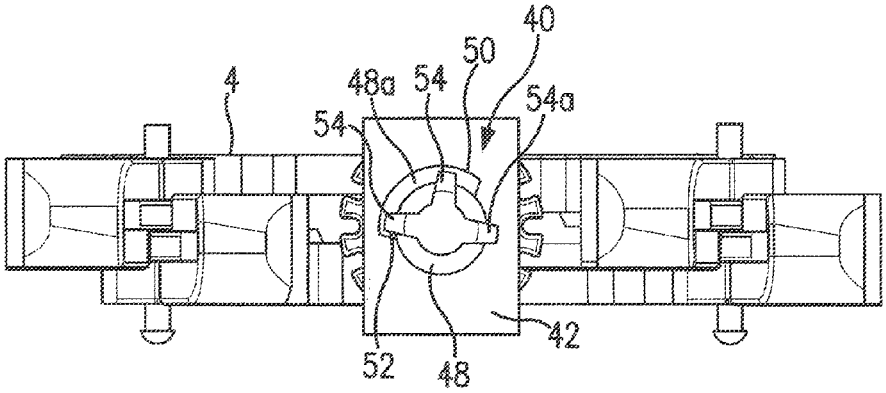
FIG. 11 is a partial top plan view, with parts removed, of the adjustable mounting of the abrasive elements of the invention of FIG. 1.
Figure 12:
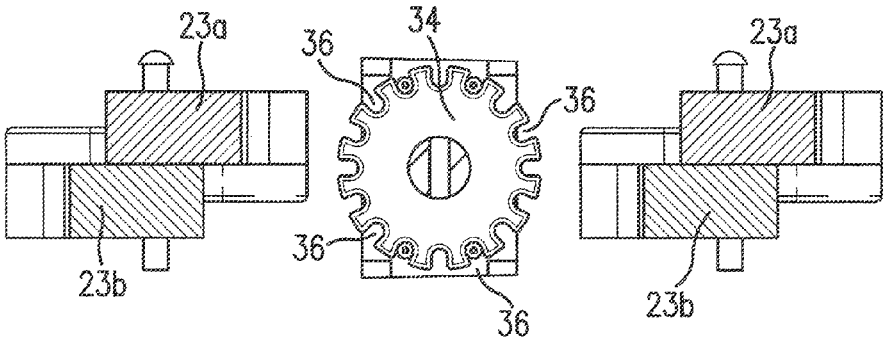
FIG. 12 is a bottom partial plan view, taken along lines 12-12 of FIG. 10, of the adjustable arms of the adjustable abrasive sharpener of FIG. 1.

As seen in FIGS. 8 and 10, the bottom of pivot arm 23*b* is formed in a curvature from which four projections 70 project into corresponding slots 62*a* for an extent dependent on the rotational position of the pivot arm 23*a* as established by the relative position of the adjustment rack 60. As seen in FIG. 5, the bottom of pivot arm 23*b* is formed with a curvature from which four projections 72 extend into a corresponding slots 62*a* for an extent on the rotational position of the pivot arm 23*b* as established by the relative position of the adjustment rack 62. From the foregoing it should apparent that rotation of knob 20 in a clockwise direction moves rack 60 left to the right viewing FIGS. 8 and 9 to pivot arm 23*a* toward pivot arm 23*b*. Similarly, clockwise rotation of knob 20 will move adjustment rack 62 from right to left through pinion 30 to pivot arm 23*b* toward pivot arm 23*a*. Thus, the angle between abrasive elements 18*a* and 18*b* in both slots are varied. To move the pivot arms 23*a*, 23*b* away from each other the knob 20 may rotate in a counter clockwise direction viewing FIG. 7. As stated previously, the knob 20 must be depressed to release the engagement in order to permit adjustment rotation of the knob 20. Indicia elements (not shown) may be provided exteriorly adjacent the knob 20 to indicate a range of sharpening angles dependent on the extent of rotation of knob 20 and pinion gear 30. After an angle of sharpening is selected dependent on desired results, the knob is released and spring 32 urges automatic upward movement of the rod 28 and circular plate 34 so as the four engagement pins 60 are inserted into four engaging slots 36 which are in alignment with the engagement pins 60 as established by the angular relationship of pivot arms 23*a*, 23*b* in a particular adjusted position. The abrasive elements 18*a*, 18*b* in the two sharpening slots may have different abrasive properties, such as a coarser and finer abrasive quality.

What is claimed is:

1. An adjustable sharpener comprising a frame having an open sharpening slot, a pair of abrasive elements being mounted in said slot, a pair of abrasive elements being pivotally mounted in said slot to form a generally V- shaped sharpening angle in conjunction with the other of said pair of abrasive elements, an adjustment actuator being mounted on said frame, a connecting assembly being operatively connected between said adjustment actuator and said pair of abrasive elements whereby said actuator causes pivotal movement of said pair of abrasive elements with respect to the other to adjust the sharpening angle of said pair of abrasive elements.

2. The adjustable sharpener according to claim 1 wherein said adjustment actuator includes a rotatable rod mounted on said frame and being operatively connected to said connecting assembly.

3. The adjustable sharpener according to claim 2 wherein said connecting assembly includes at least one gear rack engaging said rotatable rod and said pair of pivotally mounted abrasive elements.

4. The adjustable sharpener according to claim 3 wherein said rotatable rod includes a fixed gear engaging said at least one gear rack.

5. The adjustable sharpener according to claim 3 wherein said pair of pivotally mounted abrasive elements is respectively mounted on an arm assembly, said arm assembly includes a plurality of slots for respectively engaging said at least one gear rack.

6. The adjustable sharpener according to claim 4 wherein said at least one gear rack is moveable generally perpendicular to the axis of rotation of said rotatable rod.

7. An adjustable sharpener comprising a frame having a sharpening slot, a pair of pivotally mounted arms having an abrasive element being mounted in said sharpening slot to form a generally V-shaped sharpening angle with respect to each other, at least one of said pivotally mounted arms being moveable with respect to the other of said pair of pivotally mounted arms to adjust said sharpening angle, a rod operatively mounted for rotatable movement about an axis and being connected to said at least one of said pivotally arm assemblies to cause pivotal movement of said at one of said arm assemblies upon rotation of said rod to adjust said sharpening angle, said rod being mounted on said frame for movement along said axis of rotation from a first position to a second position, and said rod being locked against rotation in said first position and being capable of being rotated in said second position.

8. The adjustable sharpener according to claim 7 wherein said rod causes pivotal movement of both of said pair of pivotally mounted arms upon rotation to adjust said sharpening angle.

9. The adjustable sharpener according to claim 8 wherein said rod engages a locking bracket in said first position.

10. The adjustable sharpener according to claim 7 further including a resilient member to maintain said rod in first position.

11. The adjustable sharpener according to claim 8 further comprising a gear being mounted on said rod, a pair of connecting members being mounted on said frame, said connecting members engaging said gear and being moveable axially upon rotation of said rod, said connecting members being connected to said pair of pivotally mounted arms to adjust said sharpening angle upon said axial movement.

12. The adjustable sharpener according to claim 11 wherein said pair of connecting members are a pair of gear racks.

13. The adjustable sharpener according to claim 11 further comprising a second open sharpening slot, a second pair of abrasive elements being pivotally mounted in said second slot to form a generally V- shaped sharpening angle in said second slot, said pair of connecting members being connected to said second pair of pivotally mounted arms to adjust said sharpening angle in said second slot upon said axial movement.

14. An adjustable sharpener comprising a frame having an open sharpening slot, a pair of abrasive elements being mounted in said slot to form a generally V- shaped sharpening angle in said slot, at least one of said abrasive elements being mounted for pivotal movement, a rotatable rod being mounted on said frame, and a connecting rack assembly being mounted for axial movement on said frame and being connected between said rod and said at least one of said abrasive elements whereby rotation of said rod effects axial movement of said rack assembly to cause pivotal movement of said at least one of said abrasive elements with respect to the other of said abrasive elements to adjust said sharpening angle form by said pair of abrasive elements.

15. The adjustable sharpener according to claim 14 wherein said connecting gear assembly includes at least one gear rack.

16. The adjustable sharpener according to claim 15 wherein said rod includes a gear to engage said at least one gear rack.

17. The adjustable sharpener according to claim 14 wherein said rotatable rod is moveable along its axis of rotation from a first position locking said rod against rotation to a second position permitting rotation of said rod.

18. The adjustable sharpener according to claim 14 further comprising a second open sharpening slot on said frame, a second pair of abrasive elements being mounted in said second slot to form a generally V- shaped sharpening angle in said second slot, at least one of said abrasive elements being pivotally mounted, said connecting rack assembly being connected to said at least one pivotally mounted abrasive elements to adjust said sharpening angle in said second slot upon said axial movement.

19. The adjustable sharpener according to claim 18 wherein said pair of abrasive elements in said open and second open slots are pivotally mounted said axial movement of said connecting rack assembly simultaneously causes pivotal movement of each of said abrasives element in said open slot and said second open slot.

* * * * *